US006116549A

United States Patent [19]

Santa Cruz et al.

[11] Patent Number: 6,116,549

[45] Date of Patent: Sep. 12, 2000

[54] BAG SUPPORT STAND AND METHOD OF USE

[76] Inventors: Cathy D. Santa Cruz, 7630 Tholl Rd., Reno, Nev. 89506; Kevin L. Evanoff, 244 Lue Dela Couleurs, Sparks, Nev. 89434

[21] Appl. No.: 09/212,051

[22] Filed: Dec. 15, 1998

[51] Int. Cl.[7] ..... A63B 55/04; B65B 67/04

[52] U.S. Cl. ..... 248/97; 248/99

[58] Field of Search ..... 248/97, 95, 99, 248/94

[56] References Cited

U.S. PATENT DOCUMENTS

| | | | |
|---|---|---|---|
| 645,199 | 3/1900 | Brooks | 248/98 |
| 3,771,752 | 11/1973 | Meeh | 248/98 |
| 3,773,286 | 11/1973 | Govoni et al. | 248/97 |
| 3,818,956 | 6/1974 | Chamberlain | 141/316 |
| 3,958,785 | 5/1976 | Aboud | 248/97 |
| 4,196,880 | 4/1980 | Hynes | 248/99 |
| 4,248,278 | 2/1981 | Blodgett | 141/316 |
| 4,488,697 | 12/1984 | Garvey | 248/101 |
| 4,889,300 | 12/1989 | Gibson et al. | 248/97 |
| 5,056,932 | 10/1991 | Young | 383/36 |
| 5,499,787 | 3/1996 | Bonomo | 248/97 |
| 5,797,567 | 8/1998 | Magnafici | 248/97 |
| 5,913,496 | 6/1999 | Valdez | 248/99 |

*Primary Examiner*—Ramon O. Ramirez
*Assistant Examiner*—Jerome DeLuca

[57] ABSTRACT

A bag support stand used to support a flexible bag in an upright open position for easy filling thereof. The support stand includes unique width adjustment and height adjustment. Thus, the stand can accept and support thereon substantially any size or shape of bag of user choice.

1 Claim, 3 Drawing Sheets

BAG SUPPORT STAND AND METHOD OF USE

FIELD OF THE INVENTION

The present invention relates to stands used to support a flexible bag in an upright open position for easy filling thereof, but more particularly relates to a stand which can support substantially any type bag of choice thereon, such as a freezer bag or the like. The stand includes variable width adjustment means to allow for various sized bags of choice to be removably attached thereon, and the stand also includes variable height adjustment means.

BACKGROUND OF THE INVENTION

It is to be noted this Utility application corresponds to Provisional application Ser. No. 60/068515, filed on Dec. 22, 1997.

In recent years, home canning and freezing has become increasingly popular as this practice is most practical and economical for providing food for one or one's family. In addition, the quality, especially taste, is often better with fruits and vegetables that have been home canned or frozen than those which may be purchased in the supermarket. This is true for various reasons, but one of the most significant being the fact that the individual can choose and select the quality and maturity of the fruits and vegetables that are going to be canned or frozen.

Probably home freezing is generally preferred over canning because it is ordinarily less trouble, and because the true taste of the product being frozen can be maintained quite well in a frozen environment. But even still, home freezing requires time and effort and there are certain problems and inconveniences involved.

It is noted by the applicants that one of the most difficult problems when home canning or freezing is when one wishes to fill a freezer bag, it is very difficult to hold open the freezer bag while simultaneously pouring the substance into the bag, and this can be most difficult, messy, and wasteful if spillage occurs. It is further noted by the applicants that this is a very common problem which has been recognized, but which has not been successfully resolved, even though numerous attempts have been made, and evidence of this is clear as the prior art is very crowded and immense.

However, it is also noted that most all attempts exhibited try to resolve the problem by means of a wire configuration of some type, which supports the bag in some manner, and in most all references, this is done by inserting the bag up through the wire device, folding it over the top edge thereof, and then the bag is secured thereto by either clips, or a slidable member is inserted into the bag within the top of the device. This is not as successful as one would hope, as most often the bag cannot be completely filled to the top and also when the bag is folded over and then secured, tearing and/or rupture of the bag is incurred, which is a further disadvantage when a typical "ZIP-LOCK" bag is used, as the closure means can become damaged due to the exerted pressure thereon.

Exemplary of such devices are U.S. Pat. Nos. 4,901,959, 4,899,967, 4,889,300, 4,488,697, 4,283,032, and 3,958,785. Furthermore, each of these references do not recognize that spillage and waste is most often incurred due to the design, as none of the references include means to guide (such as a funnel member) the substance to be poured into the bag.

However, it is well known that when pouring any substance, a funnel is most advantageous and reduces spilling and waste. Therefore, U.S. Pat. Nos. 4,485,855, 4,248,278, 3,818,956, 2,928,259, 2,827,929, 2,688,429 and 645,199 each include a funnel type member to overcome the problem of spilling and reduce waste. Unfortunately, each reference includes the funnel member having a stem which is slidably engaged within substantially a base member of some type with the bag being inserted up through and folded over the top edge of the base member, and as noted above, this is a disadvantage and continues to be a problem inherent within each of the references, thus, this is a continuing problem which has not been recognized and/or addressed in a successful manner.

Therefore, the present invention recognizes multiple unresolved problems, addresses each and resolves each problem in a manner heretofore not seen, nor taught. Also, the present invention includes novel physical features as will be seen in the following specification.

SUMMARY OF THE INVENTION

Therefore, it is a primary object of the present invention to provide a unique bag stand which may be used to support a bag of choice thereon, with the bag being held in an open position for easy filling of the bag.

A further object of the present invention is to provide a bag stand which includes a funnel shaped member which is supported by multiple adjustable legs.

Yet another object of the present invention is to provide the above funnel shaped member with variable width adjustment means to allow the member to be adjustably positioned between a first and second position.

Still further it is an object of the present invention to provide the noted legs with vertical adjustment means to allow the legs to be vertically adjustably positioned and then locked into a position of choice.

Also, another object of the present invention is to provide a freezer bag stand which includes attachment means to retain a bag of choice thereon, (such as namely, a "ZIP-LOCK" bag as produced by "DOW CHEMICAL USA" of Indianapolis, Ind., P.O. Box 68511) in a removable yet fixedly attached manner.

Yet another object of the present invention is to provide a bag stand which is of a shape and size to receive and support various sized bags of choice thereon.

Still, a further object of the present invention is to provide a bag stand which can be made from substantially any material of choice, such as plastic, wood, metal, or the like.

Also a further object of the present invention is to provide a bag stand which is easily assembled, and disassembled for shipping.

A further object of the present invention is to provide a bag stand which is most economical to manufacture and is easily marketable.

Still further, an object of the present invention is to provide a bag stand which is easily filled by following the steps within the method of use, as later taught herein.

Other objects and advantages will be seen when taken into consideration with the following specification and drawings.

DETAILED DESCRIPTION OF THE DRAWINGS

Figure 1:
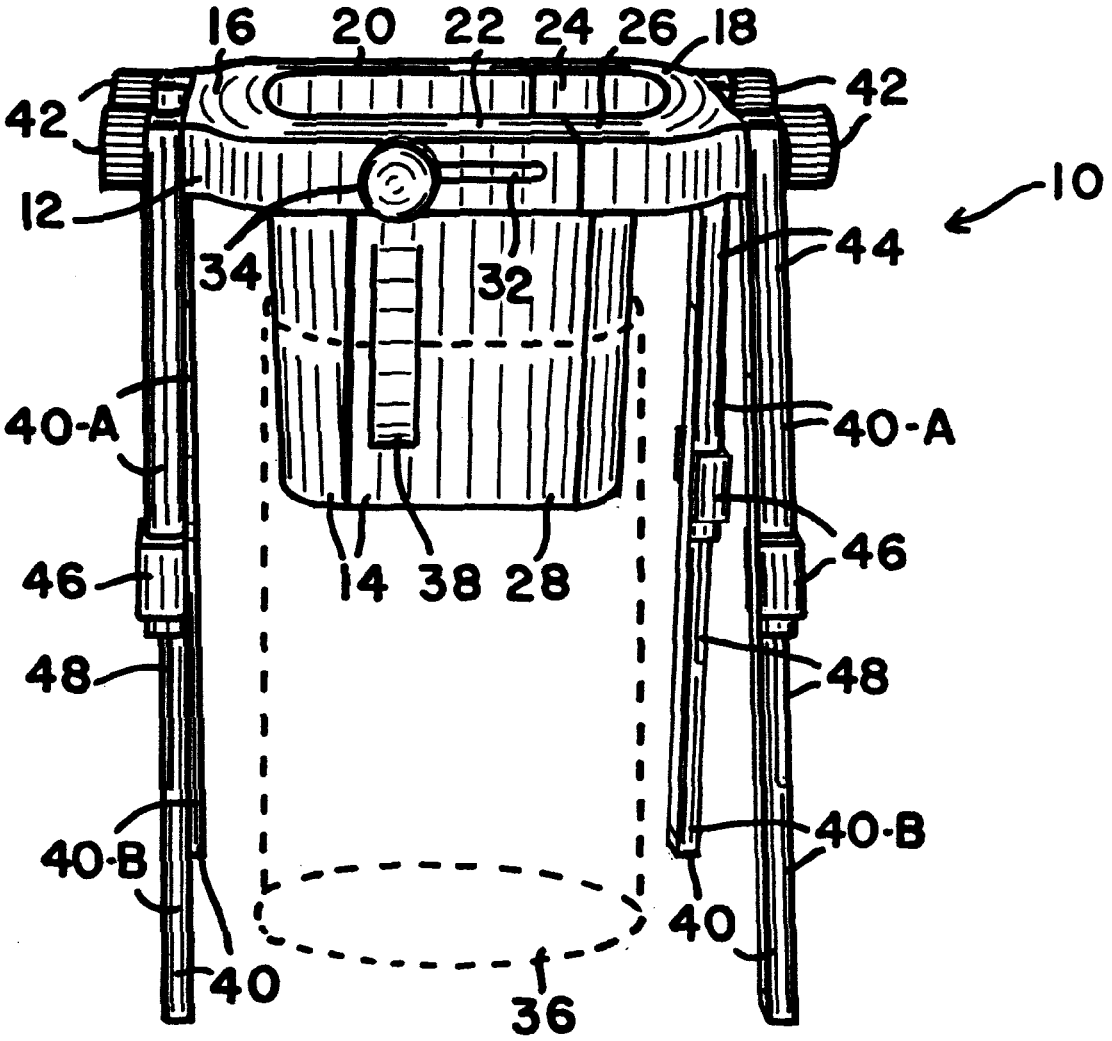
FIG. 1 is substantially a perspective view of the preferred embodiment for the present invention.

Referring now in detail to the drawings wherein like elements refer to like characters throughout the various drawings, arrow (10) is substantially an overview of the present invention which is a support stand for holding a bag in an open upright position.

Support stand (12) substantially comprising of a funnel shaped member (14) which is substantially formed from an integrally formed first half section (16) and an integrally formed second half section (18). First half section (16) having substantially a U-shaped top portion which provides a first long leg (20) and a second long leg (22). Second half section (18) having substantially a U-shaped top portion which provides a first short leg (24), a second short leg (26), and substantially a first and a second interconnected protruding lip (28 & 30), and lip 28 substantially extends from second short leg (26), while lip (30) substantially extends from first short leg (24).

Figure 2:
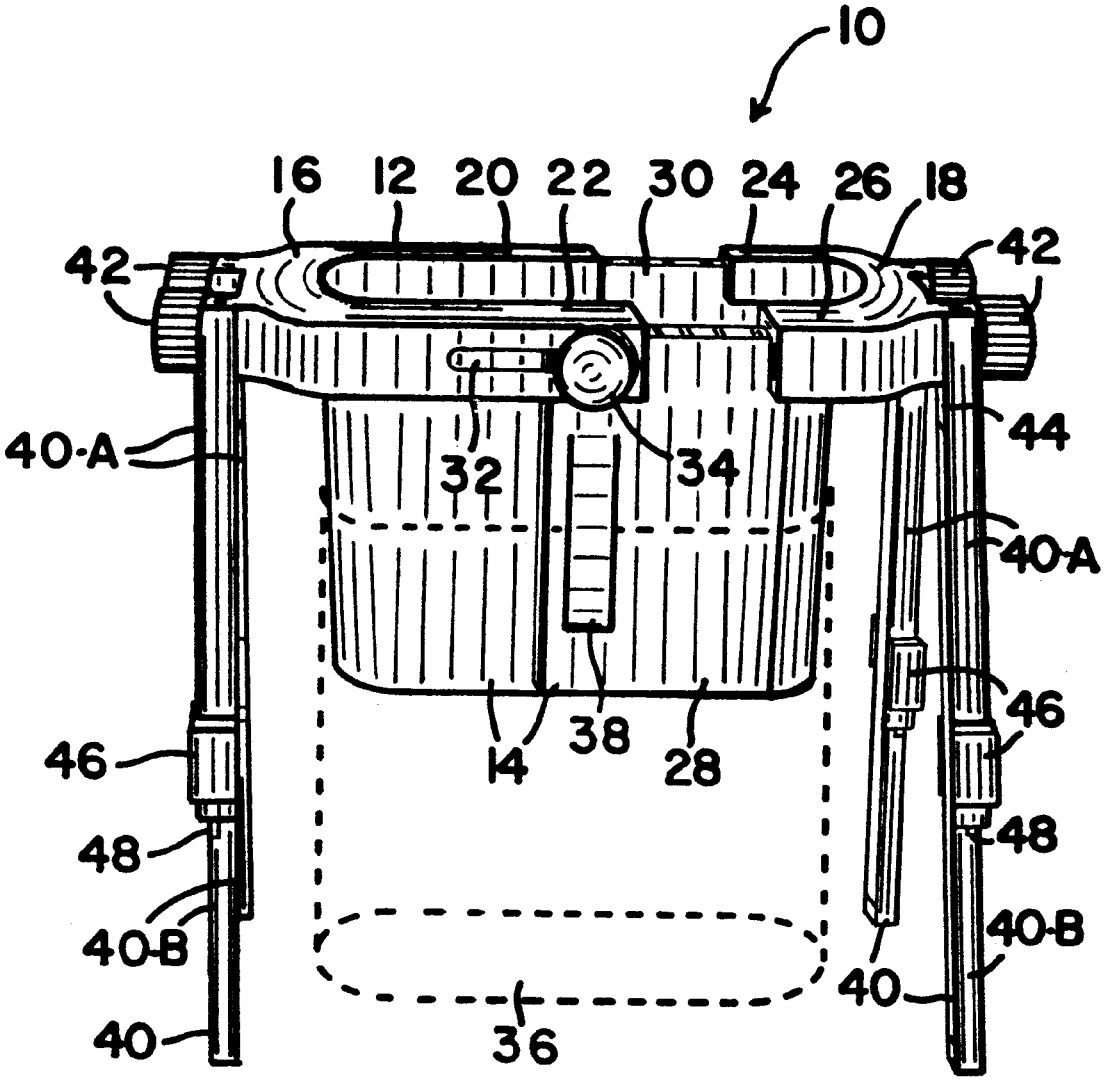
FIG. 2 is substantially a perspective view showing the device in a second position.
Figure 3:
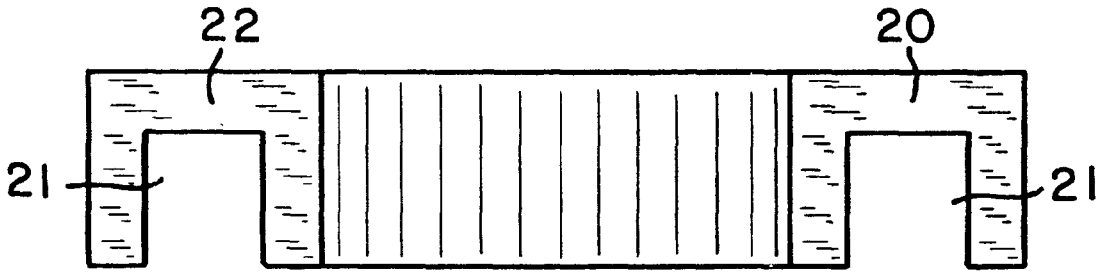
FIG. 3 is substantially a top view of the U-shaped portion of the interior cavity of the device.

First long leg (20) includes an interior cavity "(21)" which is of a shape and size to adjustably slidably receive protruding lip (30) therein. Second long leg (22) includes an interior cavity "(21)" which is of a shape and size to adjustably slidably receive protruding lip (28) therein. First long leg (20) and second long leg (22) each include an elongated horizontal slot (32) which is of a shape and size to adjustably receive a locking member therein, such as bolt (34), or the like. Whereby, long legs (20 & 22), protruding lips (28 & 30), elongated slots (32) and bolts (34) in combination, cooperate together to allow stand (12) to be manually horizontally adjustable between a first closed position, (shown in FIG. 1) and a second open position (shown in FIG. 2), thus stand (12) includes variable width adjustment means to removably attach various sized bags having different widths of choice, thereon.

Protruding lips (28 & 30) each include at least one attachment means for removably attaching a bag (36) of choice thereon, such as clip (38) (only one shown), or any other suitable attachment means of engineering choice may be used.

First half section (16) and second half section (18) each include removable attachment means for removably adjustably attaching legs (40) thereto, such as by bolts (42), or the like.

Legs (40) include variable height adjustment means of engineering choice, such as legs (40) may be formed from a first member (40-A) and a second member (40-B). Member (40-A) includes an interior slot (44) which is of a shape and size to slidably receive second member (40-B) therein, and member (40-A) includes locking means for removably adjustably locking member (40-B) therein. Any suitable locking means of engineering choice may be used, such as locking member (46) which includes an interior slot (not shown) which is of a size and shape to slidably receive an exterior lip (48). Whereby, locking member (46), interior slot (not shown) and exterior lip (48) in combination cooperate together to adjustably lock legs (40) into a position of user choice.

It will now be seen that we also provide a method of use for the present invention which includes the following steps;

a. positioning stand (12) upon support surface;

b. grasping and opening a bag (36);

c. sliding the open bag (36) up and around the outside circumference of funnel shaped member (14);

d. positioning bag (36) in between funnel shaped member (14) and at least one clip (38), thus frictionally retaining bag (30) on funnel shaped member (14) in a secure manner;

e. pouring a substance into funnel member (14) until bag (36) is substantially full;

e. removing bag (36) from funnel shaped member (14); and f. closing bag (36).

It will now be seen that we have herein provided a unique bag support stand which may be used to support a bag thereon with the bag being held in an open position for easy filling of the bag.

It will also be seen that the present invention provides a bag stand which includes a funnel shaped member which is supported by multiple adjustable legs.

Also, it will further be seen that we provide a bag support stand which includes means to retain a bag thereon in a removable yet fixedly attached manner.

It will now be seen that the present invention is a bag support stand which is of a shape and size to receive and support various sized bags of choice thereon.

It will further be seen that the present invention is a bag support stand which includes unique variable width adjustment means.

Also the present invention is a bag support stand which can be made from substantially any material of choice, such as plastic, wood, metal, or the like.

Although the invention has been herein shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatuses.

What we claim as new and wish to secure by LETTERS PATENT is:

1. A bag support stand comprising:

a funnel shaped member; multiple support legs; and bag attachment means; said funnel shaped member being formed from an integrally formed first half section and an integrally formed second half section, said first half section having a U-shaped top portion which provides a first long leg and a second long leg, said second half section having a U-shaped top portion which provides a first short leg and a second short leg, said second half section having a first interconnected protruding lip and a second interconnected protruding lip, said first interconnected protruding lip extends from said second short leg, said second interconnected protruding lip extends from said first short leg, said first long leg includes an interior cavity which is of a shape and size to adjustably slidably receive said second interconnected protruding lip therein, said second long leg includes an interior cavity which is of a shape and size to adjustably slidably receive said first interconnected protruding lip therein, and said first long leg and said second long leg each include an elongated horizontal slot which is of a shape and size to adjustably receive a locking member therein, whereby:

said first long leg, said second long leg, said first interconnected protruding lip, said second interconnected protruding lip, each said elongated horizontal slot, and said locking member in combination cooperate together to allow said stand to be manually horizontally adjustable between a first closed position and a second open position, thus said stand allows the user to removably adjustably attach various sized bags having different widths of choice thereon.

* * * * *